US007658211B1

(12) United States Patent
Dirst

(10) Patent No.: US 7,658,211 B1
(45) Date of Patent: Feb. 9, 2010

(54) TENNIS BALL RECHARGING APPARATUS METHOD

(76) Inventor: William F. Dirst, 809 Quail Ave., Harrison, AR (US) 72601

( * ) Notice: Subject to any disclaimer, the term of this patent is extended or adjusted under 35 U.S.C. 154(b) by 389 days.

(21) Appl. No.: 11/820,423

(22) Filed: Jun. 19, 2007

(51) Int. Cl.
*B65B 1/20* (2006.01)

(52) U.S. Cl. ..... 141/11; 141/51; 141/63; 141/69; 141/83; 141/95; 206/213.1

(58) Field of Classification Search ..... 141/2, 141/3, 11, 37, 51, 63, 64, 69, 72–74, 83, 141/94, 95, 98; 206/213.1, 315.9
See application file for complete search history.

(56) References Cited

U.S. PATENT DOCUMENTS

| | | | | |
|---|---|---|---|---|
| 1,207,813 | A | 12/1916 | Stockton | |
| 4,019,629 | A | 4/1977 | Dubner et al. | 206/315 |
| 4,020,948 | A | 5/1977 | Won | 206/315 |
| 4,046,491 | A | 9/1977 | Roeder | 417/44 |
| 4,073,120 | A | 2/1978 | Berggren | 53/79 |
| 4,086,743 | A | 5/1978 | Hoopes | 53/79 |
| 4,101,029 | A | 7/1978 | Feinberg et al. | 206/315 |
| 4,124,117 | A | 11/1978 | Rudy | 206/213.1 |
| 4,161,247 | A | 7/1979 | Feinberg et al. | 206/315 |
| 4,165,770 | A | 8/1979 | Goldman et al. | 141/329 |
| 4,248,275 | A * | 2/1981 | Reed | 141/4 |
| 4,372,095 | A | 2/1983 | De Satnick | 53/79 |
| 5,002,196 | A * | 3/1991 | Bassili | 220/240 |
| 5,397,018 | A * | 3/1995 | Mader | 221/102 |
| 5,593,157 | A | 1/1997 | Koros et al. | 473/606 |
| 5,615,596 | A * | 4/1997 | Issa | 92/98 R |
| 5,730,286 | A | 3/1998 | Eska | 206/315.9 |

* cited by examiner

*Primary Examiner*—Timothy L. Maust
(74) *Attorney, Agent, or Firm*—Keisling Pieper & Scott, PLC; Trent C. Keisling

(57) ABSTRACT

A method and apparatus for recharging depleted tennis balls that uses compressed carbon dioxide. A recharge pressure vessel including a cylinder with a closed end and a spaced apart open end with a connecting wall forming a charging chamber. A pressure port proximate the open end permits gas entry and exit for charging. The chamber may be filled with any number of discharged tennis balls and then is sealed and charged with high pressure heavy molecular weight gas such as carbon dioxide. The vessel is then agitated to jostle the inserted balls and within 4 to 5 days, the balls will become fully pressurized and the pressure may be released and the recharged balls remove from the vessel.

20 Claims, 1 Drawing Sheet

TENNIS BALL RECHARGING APPARATUS METHOD

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document may contain material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of recharging depleted or exhausted or dead or depressurized tennis balls. In particular, the present invention relates specifically to an apparatus and method for recharging depleted or exhausted or dead or depressurized tennis balls to restore the liveliness and optimum configuration of the individual balls. Known art may be found in U.S. Class 206, subclass 213.1 as well as in other classes and subclasses.

2. Description of the Known Art

Many games use a gas pressurized hollow ball during play (i.e. football, basketball, soccer, tennis, etc.). In the game of tennis, the ball is spherical and of a standard diameter and it is covered with a fibrous nap. Important parameters of the tennis ball are its bounce or liveliness or resiliency and this is a function of the ball's internal gas pressure, its size and spherical configuration and the condition of the fibrous nap. All of these parameters should be maintained constant and uniform from ball to ball and during the useful life of the ball. Since the reaction of the ball to the impact of the racket and its ground rebound characteristics are functions of the above parameters, any significant change or variation thereof adversely affects the proper playing of the game.

As is well known, the resiliency exhibited by tennis balls is due, at least in part, to the pressurization of the tennis balls during manufacturing. To be suitable for tournament play, tennis balls must be able to meet quite rigid specifications regarding their size, the distance to which they rebound when dropped from a standard height, the amount of deformation they exhibit under an applied standard force, and their surface characteristics. All manufacturers strive to comply with these rigid specifications to insure that the balls they manufacture exhibit the uniformity demanded by serious amateur as well as professional tennis competitors.

Tennis balls are generally packaged and marketed in pressurized hermetically sealed containers so as to minimize or prevent any diffusion outwardly of the pressurized gas in the ball which would reduce its liveliness and so as to obviate any distortion of the ball from its standard size or shape as a consequence of the ball's high internal pressure. A basic problem with tennis balls presently in use is that, as the balls age, they lose pressure. This pressure loss results from the diffusion through the tennis ball surface of whatever gas may be used to inflate tennis balls during manufacture. Partially to combat this loss of pressure, tennis balls have, for some time, been marketed in pressurized canisters, generally three tennis balls to a canister. Of course, once the canister in which the tennis balls have been sold is opened, the tennis balls are removed from their pressurized environment and, as a result of the pressure differential across their surfaces, they begin to be deflated and the distortion of the ball commences so that the ball is thereafter of limited useful life in the proper playing of tennis.

As stated previously, with usage and/or the passage of time, the internal pressurization of tennis balls eventually escapes until the internal pressure of the tennis balls drops to atmospheric pressure. At that time, the unpressurized and depleted tennis balls are considered to be dead or flat even though their the tennis balls may otherwise be acceptable. Depleted tennis balls are typically discarded. While many of the tennis balls may be retired because their surfaces have become worn beyond acceptable limits, many more tennis balls are retired simply because they have lost their pressurization. Discarding depleted but otherwise acceptable tennis balls can be extremely wasteful, particularly at large clubs such as tennis clubs and country clubs where the quantity of depleted tennis balls can be high.

Others have proposed solutions to deal with depleted tennis balls, including recharging and/or recycling apparatus and methods. Patents disclosing information relevant to tennis ball pressurization include U.S. Pat. No. 4,124,117 issued to Rudy on Nov. 7, 1978; U.S. Pat. No. 1,207,813 issued to Stockton on Dec. 12, 1916; U.S. Pat. No. 4,019,629 issued to Dubner et al. on Apr. 26, 1977; U.S. Pat. No. 4,020,948 issued to Won on May 3, 1977; U.S. Pat. No. 4,046,491 issued to Roeder on Sep. 6, 1977; U.S. Pat. No. 4,073,120 issued to Berggren on Feb. 14, 1978; U.S. Pat. No. 4,086,743 issued to Hoopes on May 2, 1978; U.S. Pat. No. 4,101,029 issued to Feinberg et al. on Jul. 18, 1978; U.S. Pat. No. 4,161,247 issued to Feinberg et al. on Jul. 17, 1979; U.S. Pat. No. 4,165,770 issued to Goldman et al. on Aug. 28, 1979; and U.S. Pat. No. 4,372,095 issued to De Satnick on Feb. 8, 1983. Each of these patents are hereby expressly incorporated by reference in their entirety.

U.S. Pat. No. 4,124,117 issued to Rudy on Nov. 7, 1978, entitled Apparatus For Repressuring Tennis and Similar Play Balls shows a portable device similar to the container most tennis balls are originally packaged in for storage. The patent discusses a system for repressuring a tennis ball or similar play ball, which has lost a portion of its initial inflation pressure, in which a container or enclosure for the ball contains a chemical and a suitable fluid that reacts with the chemical to generate a gas at atmospheric pressure capable of diffusing through the permeable elastomeric material of the ball to elevate the total pressure within the ball toward its initial pressure value. This device uses solid pellets that mix with a liquid in the container to generate the repressurizing gas.

U.S. Pat. No. 1,207,813 issued to Stockton on Dec. 12, 1916, entitled Method for Preserving Tennis Balls or Other Objects Containing Fluid Under Pressure shows a container for a ball. The patent discusses a method for preserving tennis balls or other objects containing fluid under pressure.

U.S. Pat. No. 4,019,629 issued to Dubner et al. on Apr. 26, 1977, entitled Pressurized Tennis Ball Container shows another portable device similar to the container most tennis balls are originally packaged in for storage. This patent discusses a pressurized tennis ball container has a cover which fits onto a standard metal tennis ball can. The cover includes a hand pump having a sliding seal which opens to permit rapid refilling of the hand pump cylinder with air during the upstroke of the piston, an air pressure indicator, which indicates the pressure within the can, a pressure release member to release the air pressure within the can to facilitate opening the cover, and an improved diaphragm valve.

U.S. Pat. No. 4,020,948 issued to Won on May 3, 1977, entitled Tennis Ball Storage Container shows another portable device similar to the container most tennis balls are originally packaged in for storage. This patent discusses a tennis ball storage container of the type wherein the balls located inside the container are maintained in a compressed air surrounding in order to prevent microscopic penetration of compressed air from inside the ball during the storage. The container comprises a cylindric storage container and a cylindric lid arranged to place over the container to close same. Sealing means are arranged on the container and on the lid which are effective to maintain a generally air tight sealing engagement between the container and the lid during the operation of placing the lid over said container. The sealing means prevents air present in the space defined by the container and the lid as the lid is being placed over the container. The sealing means prevents air present in the space defined by the container and the lid as the lid is being placed over the container. The volume defined by the inside of the lid amounts to at least two thirds of the volume defined by the container.

U.S. Pat. No. 4,161,247 issued to Feinberg et al. on Jul. 17, 1979, entitled Method of and Means for Preserving Tennis Balls or the Like shows another portable device similar to the container most tennis balls are originally packaged in for storage. This patent discusses a gas pressurized ball is packaged under pressure by first compressing the ball about its girth and then compressing it about its full surface in the smaller spherical cavity of a mold section. A device for compressing the ball includes a collar member of smaller diameter than the ball and a pair of spherically faced cavitied mold members which are assembled with the collar to form a spherical closure chamber. The mold members may include lips which enter the collar opening or may, with the collar face, form the closure chamber. The collar and a spherically faced cavitied mold member, in one form, are integrally formed and a ball injection plunger registers with a bore in the mold member. Another device includes three mutually hinged members each having a cavity so that when the members are swung to a closed condition the cavities form a spherical chamber smaller than the ball. Another form of the device includes a cylindrical receptacle closed by an elastomeric cap provided with an inflation valve and locking collar to permit pressurizing of the receptacle.

U.S. Pat. No. 4,073,120 issued to Berggren on Feb. 14, 1978, entitled Apparatus for Repressurizing Tennis Balls shows a needle-like device that penetrates the ball to be repressurized. This patent discusses a method and apparatus for repressurizing tennis balls or other balls not being normally provided with an air fill valve and for internally sealing the same after repressurizing, which includes: a needle-like element for penetrating the skin of the ball and having a passage therethrough for the passing of a sealing medium and air into the ball, compressing the ball to create a negative pressure therein, a sealant containing member which is penetrable by the extending end of the needle element for drawing the sealant into the ball when the compressive force is released and a source of positive pressure which is attachable to the extending end of the needle element for pressure application to the interior of the ball. The sealant is in flowable condition for a period and will flow about the internal end of the needle to form a supply about the aperture formed by the needle such that when the same is withdrawn, the sealant will flow in and over the aperture to seal the same.

U.S. Pat. No. 4,086,743 issued to Hoopes on May 2, 1978, entitled Tennis Ball Revitalizer shows another needle-like device for repressurizing a tennis ball. This patent is directed to a simple, easily-operated device is provided by which a "dead" tennis ball can be revitalized by injecting it with a gas, preferably in the form of an aerosol propellant. The device described comprises an aerosol container suitably charged and connected to a tubular needle and also a ball-receiving cup. Pressure from the propellant restores original bouncing quality to the ball. A sealant can be mixed with the propellant or gas if desired or necessary. Proper selection of propellant and sealant mixture automatically meters the amount of sealant moving into the ball. Safety features of the device protect the needle.

U.S. Pat. No. 4,165,770 issued to Goldman et al. on Aug. 28, 1979, entitled Apparatus to Rejuvenate Tennis Balls shows another needle-like device for repressurizing a tennis ball. This patent discusses an inflation device for tennis balls and the like wherein a pressure vessel having a resiliently closed discharge valve is provided with an operator fitting on the valve and a hollow impaling element on the operator fitting for passing fluid from the vessel, and an outwardly facing ball seat operatively connected to the fitting for actuating the latter upon depression by a ball on the seat, which ball is simultaneously penetrated by the impaling element for receiving pressurized fluid.

U.S. Pat. No. 4,372,095 issued to De Satnick on Feb. 8, 1983, entitled Tennis Ball Pressurizer shows another needle-like device for repressurizing a tennis ball. This patent discusses a tennis ball pressurizer having a source of pressurized gas, a regulating valve for controllably releasing the gas and a hollow needle for injecting the gas into the ball. The needle has an internal bevel at one end which cuts a plug from the wall of the ball. The plug seats into the needle and is partially exposed beyond the end of the needle. Gas is released from the pressure source and passes through the needle to enter into the ball through a side vent in the needle. As the needle is withdrawn from the ball after it is repressurized, the plug engages in and seals the puncture hole.

Many of the preceding devices are either complex and inconvenient to employ or they have been unsatisfactory in that they tended to damage the surface of the ball, thereby adversely affecting the ball's playing properties and otherwise left much to be desired.

Another significant drawback of the prior art is that such prior art contemplates pressurization of a very small number of tennis balls, typically, three tennis balls in a container of a configuration similar to the containers in which tennis balls are marketed.

The increasing popularity of tennis and the resultant growth in the offering of group tennis lessons, as well as the burgeoning tennis club industry, have resulted in the use of far more tennis balls than such prior art apparatus can economically preserve. For example, it is not uncommon for a tennis club in a large metropolitan area to use 10,000 or more tennis balls in a year. To address the large quantities of balls, some have proposed "batch" systems. "Batch" processing of tennis balls can be a real and immediate solution that may result in significant economy, particularly for users of large numbers of tennis balls. As used by many, batch processing refers to the processing of, for example, 200 or more tennis balls at one time.

For example, U.S. Pat. No. 4,101,029 issued to Feinberg et al. on Jul. 18, 1978, entitled Tennis Ball Rejuvenator and Maintainer shows pressure vessel for batch processing tennis balls. This patent discusses a pressure vessel for storing tennis balls includes a cylindrical open topped receptacle having in its inside upper border a peripheral groove separably engaging an elastomeric O-ring gasket provided with a finger removal tab. A vertical coaxial post is anchored to the receptacle base and axially movably supports for movement between limited raised and depressed positions a coupling member which is spring urged to raised position and releasably locked in its depressed position. A dished cover is coaxially separably connected to the coupling member and has an outwardly downwardly inclined peripheral lip engaging the O-ring when the cover is in raised position to effect an air tight seal. Mounted on the receptacle peripheral wall and communicating with the interior thereof are a pressure gauge, a pressure release and safety valve and a pressurizing check valve.

U.S. Pat. No. 4,046,491 issued to Roeder on Sep. 6, 1977, entitled Tennis Ball Preserver shows a large container for batch processing tennis balls. This patent is directed to an apparatus for batch processing tennis balls for preserving their internal pressurization. The apparatus includes a high pressure reservoir and a lower pressure storage chamber integrally and unitarily housed within a single tank and separated by a bulkhead. An air compressor is connected to the high pressure reservoir and is controlled by a gauge apparatus to maintain a desired high pressure within the reservoir. The reservoir and storage chamber are connected together by a conduit which includes a low pressure regulator to maintain a desired pressure in the storage chamber. A passageway with an air-tight, removable lid provides access to the interior of the low pressure chamber for loading and unloading the tennis balls. The apparatus may also be used to repressurize tennis balls which have lost some of their inflation with compressed air.

The known art fails to address many perceived shortcomings in the industry. For example, a desirable improvement in the art would be the introduction of a system adapted to quickly recharge depleted tennis balls economically and efficiently wall also providing the ability to store tennis balls indefinitely.

Thus, it may be seen that these prior art patents are very limited in their teaching and utilization, and an improved method and apparatus for effectively recharging tennis balls and particularly large quantities of tennis balls quickly is needed to overcome these limitations. What is needed then is an improved apparatus and method for quickly recharging large quantities of depleted tennis balls in an efficient and economical manner.

SUMMARY OF THE INVENTION

The present invention is directed to an improved apparatus and method for quickly recharging large quantities of depleted tennis balls in an efficient and economical manner. In accordance with one exemplary embodiment of the present invention, a method and apparatus for recharging depleted tennis balls is provided that uses compressed carbon dioxide. Of particular note is the invention's ability to quickly and economically recharge balls. The invention may advantageously utilize multiple pressure vessels to permit a user to simultaneously recharge and store recharged balls. The multiple pressure vessels may be arranged to discharge gases from a recharging vessel at high-pressure into a storage vessel maintained at a lower pressure. In this manner, gas may be recycled by moving it from a high pressure vessel to a low pressure vessel before discharge. High-pressure gas may also be recycled by moving it from a recharge vessel into another recharge vessel to partially charge the new recharge vessel.

In one exemplary embodiment of the invention, a recharge pressure vessel is filled with any number of discharged, flat tennis balls. The vessel is sealed and charged with 50 psi of carbon dioxide. The vessel is then rotated to dislodge any balls that may have been wedged into the side of the vessel to prevent wedged balls from becoming misshapen. The vessel is rotated periodically to maintain the desired ball shape. Within 4 to 5 days, the balls become fully pressurized and the pressure may be released and the recharged balls remove from the vessel. It is possible to recharge the balls at a pressure as low as 20 psi, but such a lower pressure increases the charging time to 6 weeks or longer. Thus, higher pressures exponentially decrease the charging time.

It is thus an object of the present invention to provide an apparatus and process that can be economically operated to batch process tennis balls in order to restore a desirable internal pressurization, thereby significantly increasing the useful life of the tennis balls.

It is a basic object of the present invention to provide an apparatus and method which may be used to repressurize tennis balls which have lost a significant amount of their original pressurization.

An additional object of the present invention is to provide an apparatus for storing tennis balls in a pressurized environment to preserve their pressurization wherein the apparatus is proportioned and designed for bulk processing of tennis balls and sufficient to maintain constant pressure for such batch processing.

It is a principal object of the present invention to provide an improved device for preserving the playing characteristics of an internally gas pressurized ball.

Another object of the present invention is to provide an improved vessel for preserving the playing characteristics of a supply of internally gas pressurized balls during the prolonged storage thereof.

Still another object of the present invention is to provide an improved pressure vessel for storing a supply of gas pressurized balls, such as tennis balls and the like, to preserve their original liveliness, bounce, configuration and shape.

Still a further object of the present invention is to provide an improved vessel of the above nature characterized by its simplicity, ruggedness, reliability, ease and convenience of use and application, and great versatility and adaptability.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
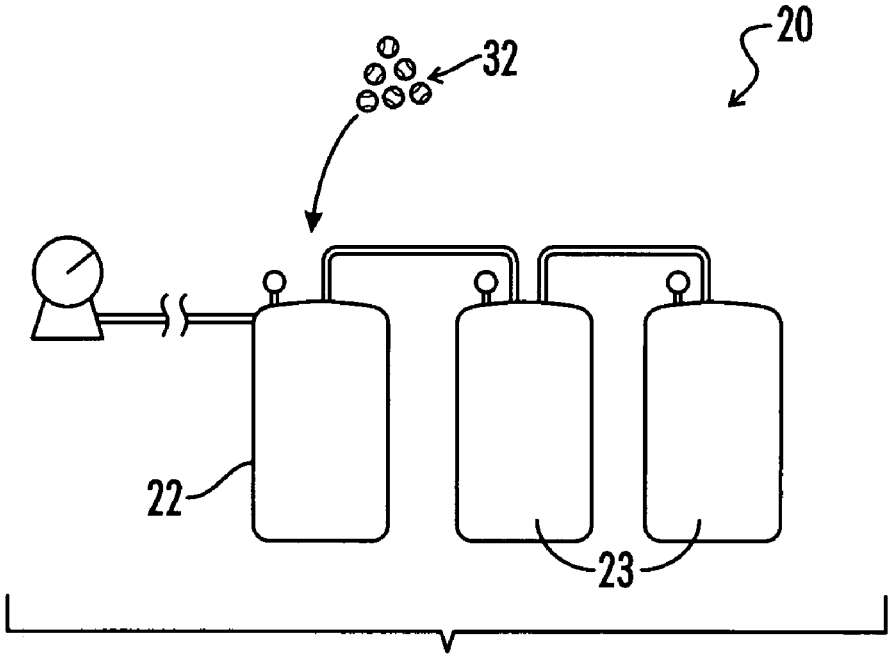
FIG. 1 is a schematic view of a recharging system in accordance with an exemplary embodiment of the invention; and, FIG. 2 is a partially fragmented perspective view of a recharging tank showing several tennis balls being recharged therein.
Figure 2:
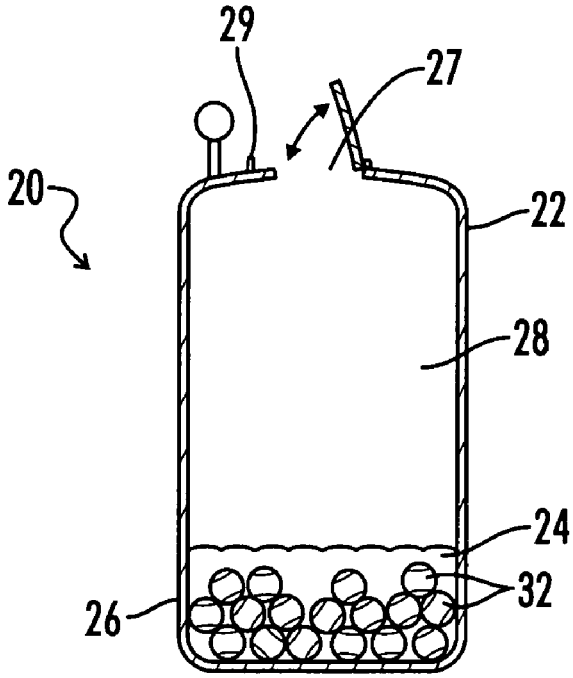

As shown in FIG. 1 of the drawings, one exemplary embodiment of the present invention is generally designated by reference numeral 20. The present invention employs a cylindrical pressure vessel 22 with an internal charging chamber 24 that is essentially impermeable when sealed.

The chamber 24 is formed from the hollow vessel interior bounded between a closed end 26 and a spaced apart removable end 27 with a wall 28 extending therebetween. The removable end 27 may include the entire cylinder end or a portion thereof. A charging port 29 penetrates vessel 22 proximate removable end 28. The charging port 29 permits the entry and removal of gasses from chamber 24. A pressure gauge may penetrate vessel 22 adjacent port 29 or alternatively a removable pressure gauge may be placed on port 29 during tennis ball charging to thereby measure the internal pressure in chamber 24.

The invention may include a series of storage vessels 23 that are virtually identical to pressure vessel 22. The storage vessels may be appropriately plumbed to reuse gas released from the charging vessel 22 or they may be supplied with gas separately as appropriate. Such storage vessels may be used to store recharged tennis balls at 17 psi indefinitely.

Of particular relevance to the present invention is Dalton's law. It says the total pressure of a gas is equal to the sum of the partial pressures of each of the component gases:

$$P_{total}=P_1+P_2+P_3 \ldots +P_n$$

If we consider air, this means the total atmospheric pressure of 1.013 bars (14.7 pounds per square inch absolute) is the sum of the partial pressures of all its constituents: nitrogen, oxygen, water vapor, argon, carbon dioxide, and various other gases in trace amounts. In particular, air contains roughly 78% nitrogen, 21% oxygen, 0.93% argon, 0.04% carbon dioxide, and trace amounts of other gases, in addition to variable quantities of water vapor, which normally approximates 3%. The two most dominant components in dry air are Oxygen and Nitrogen. Oxygen has an 16 atomic unit mass and Nitrogen has a 14 atomic units mass. Since both these elements are diatomic in air —$O_2$ and $N_2$, the molecular mass of Oxygen is 32 and the molecular mass of Nitrogen is 28. Since air is a mixture of gases the total mass can be estimated by adding the weight of all major components as shown below:

| Components in Dry Air | Volume Ratio compared to Dry Air | Molecular Mass - M (kg/kmol) | Molecular Mass in Air |
|---|---|---|---|
| Oxygen | 0.2095 | 32.00 | 6.704 |
| Nitrogen | 0.7809 | 28.02 | 21.88 |
| Carbon Dioxide | 0.0003 | 44.01 | 0.013 |
| Hydrogen | 0.0000005 | 2.02 | 0 |
| Argon | 0.00933 | 39.94 | 0.373 |
| Neon | 0.000018 | 20.18 | 0 |
| Helium | 0.000005 | 4.00 | 0 |
| Krypton | 0.000001 | 83.8 | 0 |
| Xenon | $0.09\ 10^{-6}$ | 131.29 | 0 |
| Total Molecular Mass of dry Air | | | 28.97 |

Water vapor—$H_2O$—is composed of one Oxygen atom and two Hydrogen atoms. Hydrogen is the lightest element at 1 atomic unit while Oxygen is 16 atomic units. Thus the water vapor atom has an atomic mass of 18 atomic units. At 18 atomic units, water vapor is lighter than diatomic Oxygen with 32 units and diatomic Nitrogen with 28 units. Thus, it is important to note that water vapor in air will replace other gases and reduce the total density of the mixture and hence dry air is more dense than humid air. Carbon dioxide ($CO_2$) on the other hand has a atomic mass of 44.01, which is more dense than dry air at 28.97.

In the charging container 22, carbon dioxide is kept at 50 psi during charging. The introduction of multiple depleted tennis balls 42 introduces a quantity of air at atmospheric pressure (i.e. air at approximately 14.7 psi). The total quantity is dependent upon the number of tennis balls introduced but can be expected to be the number of tennis balls multiplied by the internal volume of each ball, which can be calculated based upon the formula: sphere volume$=\frac{4}{3}\cdot\pi\cdot r^3=(\pi\cdot d^3)/6$. The acceptable measurements for the external diameter of tennis balls according to the International Tennis Federation is 2.575 inches to 2.700 inches with the outer covering and internal rubber core having a thickness of approximated 0.125 inches. Thus, the appropriate diameter is approximately 2.5 inches and the internal volume of each ball is approximately 8.17 cubic inches. Fifty such balls would have an internal volume of 408.5 cubic inches. The charging chamber volume is much larger.

The volume of a cylinder can be calculated using the formula: Volume$=\pi\cdot r^2\cdot$height$=\frac{1}{4}\cdot\pi\cdot d^2\cdot$height. In one exemplary embodiment, the charging chamber 24 has a radius of approximately 4-6 inches and a height of approximately 2.5-3.0 feet (i.e. 30 inches). Thus, the volume of the charging chamber would be approximately 3391 cubic inches. Such a charging chamber can hold 50 or more tennis balls.

Introducing 50 flat tennis balls 32 at atmospheric pressure into the charging chamber does not change the pressure or gas concentrations inside the chamber, which is already at ambient room conditions. After the balls are added, the pressure in the charging chamber 25 is increased to 50 psi by introducing an appropriate quantity of pressurized carbon dioxide, generally in the range of 1-5 pounds of materials. The added carbon dioxide initially fills the charging chamber 24, increasing the pressure throughout the charging container. Each of the tennis balls 30 acts as a small pressure vessel with permeable walls that the pressurized carbon dioxide gas must permeate over time. The internal pressure of each tennis ball is initially at 14.7 psi (i.e. 1 atm) but over time the pressurized carbon dioxide at 50 psi will penetrate the tennis ball exterior 32 as well as the semi-permeable rubber core or internal wall 34 and begin equalizing the internal tennis ball pressure with the chamber internal pressure. As the tennis ball pressure increases, the chamber pressure decreases accordingly. After approximately 4 days, the internal tennis ball pressures will have risen to 17 psi while the chamber pressure will have decreased from 50 to 47 psi. Thus it is possible to monitor the status of the charging tennis balls by monitoring the decreasing pressure of the charging chamber 30 to determine when the balls are recharged.

It has been found that the number of tennis balls being recharged is not especially important in that 3 balls can be recharged in essentially the same time frame as 30 balls. However, increasing the internal pressure of the recharging chamber from 50 to 60 psi did decrease the recharging time from 4 days to 3 days.

The steps for implementing the present invention include the following. The chamber 24 is emptied and open and at ambient atmospheric condition. Several depleted tennis balls (i.e. up to around 50) are then introduced into the chamber 24 through the opened removable end 28. End 28 is then sealed. A gas preferably heavier in molecular weight than air and most preferentially carbon dioxide is introduced into the chamber 24 through port 29. As additional gas is introduced, the pressure inside chamber 24 rises above 14 psi and then above 17 psi. While feasible to operate at lower pressures, it has been determined through experimentation that practicable time periods (i.e. less than 10 days) requires a chamber pressure of at least 40 psi and more preferentially 50 psi. Once the pressure chamber 24 is charged to 50 psi, the chamber may be agitated to jostle the balls 32 inside the chamber. This prevents balls from becoming misshapen as a result of being lodged or otherwise captivated against a wall or the like. The chamber pressure is monitored with a pressure gauge, which may be a permanent part of the vessel 22 or used with port 29. As the chamber pressure decreases, the pressure inside the balls will increase correspondingly. Once a desirable pressure decrease has occurred (i.e. 3 psi drop) a corresponding pressure increase in the balls will occur as well. Thus, once the chamber pressure drops 3 psi the internal ball pressure will have risen from 14 to 17 psi and the balls will be sufficiently recharged to terminate the recharging process. The pressure in chamber 22 is then bleed off through port 29 until at an acceptable level (i.e. 17 psi for storage and 14 psi to open the chamber).

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A method of recharging deplete tennis balls comprising the steps of:

filling a pressure chamber by introducing a plurality of discharged tennis balls with substantially ambient internal pressure into said chamber while said chamber remains at ambient pressure;

charging said chamber by sealing said chamber and then increasing the internal pressure of said chamber by introducing a quantity of gas with a molecular weight heavier than air;

agitating said chamber to jostle said balls within said chamber;

monitoring the pressure inside said chamber to determine when said balls are recharged to have an internal pressure of at least 17 psi;

relieving the internal pressure of said chamber after said balls reach an internal pressure of 17 psi.

2. The method of claim 1 wherein said chamber comprises a hollow cylinder having a removable end for receiving said balls and a port for adding or removing gas thereto.

3. The method of claim 2 wherein said chamber comprises a pressure gauge adapted to display internal chamber pressure.

4. The method of claim 1 wherein said agitating step occurs multiple times during the charging of said balls.

5. The method of claim 4 wherein said agitating step occurs at least daily.

6. The method of claim 1 wherein said gas is carbon dioxide.

7. The method of claim 1 wherein said internal chamber pressure is increased to at least 50 psi.

8. A recharged tennis ball produced in accordance with the process of step 1.

9. A method of recharging deplete tennis balls comprising the steps of:

filling a pressure chamber by introducing a plurality of discharged tennis balls with substantially ambient internal pressure into said chamber while said chamber remains at ambient pressure;

charging said chamber by sealing said chamber and then increasing the internal pressure of said chamber to at least 50 psi by introducing a quantity of gas with a molecular weight heavier than air;

agitating said chamber to jostle said balls within said chamber;

monitoring the pressure inside said chamber to determine when said balls are recharged to have an internal pressure of at least 17 psi;

relieving the internal pressure of said chamber to not higher than 17 psi after said balls reach an internal pressure of 17 psi.

10. The method of claim 9 wherein said chamber comprises a hollow cylinder having a removable end for receiving said balls and a port for adding or removing gas thereto.

11. The method of claim 10 wherein said chamber comprises a pressure gauge adapted to display internal chamber pressure.

12. The method of claim 9 wherein said agitating step occurs multiple times during the charging of said balls.

13. The method of claim 12 wherein said agitating step occurs at least daily.

14. The method of claim 9 wherein said gas is carbon dioxide.

15. A recharged tennis ball produced in accordance with the process of step 9.

16. A method of recharging deplete tennis balls comprising the steps of:

filling a pressure chamber by introducing a plurality of discharged tennis balls with substantially ambient internal pressure into said chamber while said chamber remains at ambient pressure;

charging said chamber by sealing said chamber and then increasing the internal pressure of said chamber to at least 50 psi by introducing a sufficient quantity of carbon dioxide;

agitating said chamber to jostle said balls within said chamber;

monitoring the pressure inside said chamber to determine when said balls are recharged to have an internal pressure of at least 17 psi;

relieving the internal pressure of said chamber to not higher than 17 psi after said balls reach an internal pressure of 17 psi.

17. The method of claim 16 wherein said chamber comprises a pressure gauge adapted to display internal chamber pressure.

18. The method of claim 16 wherein said agitating step occurs multiple times during the charging of said balls.

19. The method of claim 18 wherein said agitating step occurs at least daily.

20. A recharged tennis ball produced in accordance with the process of step 15.

* * * * *